US012269085B2

(12) United States Patent
Nakagawa et al.

(10) Patent No.: US 12,269,085 B2
(45) Date of Patent: Apr. 8, 2025

(54) ANCHOR FOR REINFORCING BAR MADE OF FIBER-REINFORCED PLASTIC AND MANUFACTURING METHOD THEREFOR

(71) Applicant: NAKAGAWA SANGYO Co., Ltd., Inuyama (JP)

(72) Inventors: Hiroshige Nakagawa, Inuyama (JP); Noriaki Nakagawa, Inuyama (JP)

(73) Assignee: NAKAGAWA SANGYO Co., Ltd., Inuyama (JP)

( * ) Notice: Subject to any disclaimer, the term of this patent is extended or adjusted under 35 U.S.C. 154(b) by 0 days.

(21) Appl. No.: 18/156,642

(22) Filed: Jan. 19, 2023

(65) Prior Publication Data

US 2023/0311198 A1 Oct. 5, 2023

(30) Foreign Application Priority Data

Mar. 9, 2022 (JP) ..... 2022-035763

(51) Int. Cl.
*E04C 5/07* (2006.01)
*B21K 1/12* (2006.01)

(52) U.S. Cl.
CPC . *B21K 1/12* (2013.01); *E04C 5/07* (2013.01)

(58) Field of Classification Search
CPC ..... B21K 1/12; E04C 5/07; E04C 5/18; E04C 5/01; E04C 5/08; F16B 13/0866;
(Continued)

(56) References Cited

U.S. PATENT DOCUMENTS 1,367,080 A * 2/1921 Ogden ..... F16B 13/0841 411/33
2,147,357 A * 2/1939 Scholtes ..... F16B 13/128 411/33

(Continued)

FOREIGN PATENT DOCUMENTS

DE 4444510 A1 * 6/1996 ..... A61B 17/68
EP 1887230 A2 * 2/2008 ..... F16B 13/001

(Continued)

OTHER PUBLICATIONS

English translation of Decision to Grant a Patent dated Nov. 8, 2022, in related JP application No. 2022-0035763.

*Primary Examiner* — Jason W San
*Assistant Examiner* — Dil K. Magar
(74) *Attorney, Agent, or Firm* — J-TEK LAW PLLC; Jeffrey D. Tekanic; Scott T. Wakeman

(57) ABSTRACT

Anchor pieces (1A, 1B) made of elongated metal plates (11) detachably contact each other to form an anchor (H) for a reinforcing bar (Rb) made of fiber-reinforced plastic to be used in prestressed concrete. Elongated holes (12) respectively extend in a width direction of each of anchor pieces at regular intervals in a longitudinal direction thereof. At least one locking half portion (13) is formed in each anchor piece by deforming an area (Y) between adjacent elongated holes and has a convex semicircular shape or quarter sphere shell shape. At least one annular locking portion (14) is formed by the at least one locking half portion of the two anchor pieces when the two anchor pieces are in contact with each other. The annular locking portion has a circular inner space in transverse cross-section and is configured to engage the reinforcing bar (Rb) when disposed therein.

20 Claims, 5 Drawing Sheets

(58) Field of Classification Search
CPC ..... F16B 13/122; F16B 13/128; F16B 13/02; F16B 13/025; F16B 21/075; F16B 13/126; F16B 13/141; B28B 23/02; B28B 23/00; B23P 19/02; E04G 21/00
USPC ..... 411/511, 32–33, 80.2, 80.5, 21, 82; 52/749.1
See application file for complete search history.

(56) References Cited

U.S. PATENT DOCUMENTS 4,340,330 A * 7/1982 Reidel ..... F16B 13/061 411/33
4,523,880 A * 6/1985 Isler ..... E21D 21/008 411/33
4,566,832 A * 1/1986 Mirsberger ..... F16B 13/06 411/21
4,596,503 A * 6/1986 Mirsberger ..... F16B 13/02 411/74
4,834,600 A * 5/1989 Lemke ..... F16B 13/12 411/908
5,080,543 A * 1/1992 Murphy ..... F16B 13/124 411/44
5,143,497 A * 9/1992 Haage ..... F16B 13/124 411/21
5,145,301 A * 9/1992 Yamamoto ..... F16B 13/141 411/72
5,219,452 A * 6/1993 Yamamoto ..... F16B 13/141 411/930
5,431,516 A * 7/1995 Haage ..... F16B 13/124 411/80.1
5,501,551 A * 3/1996 Wright ..... E21D 20/025 411/33
7,722,295 B2 * 5/2010 Cook ..... E21D 21/008 405/259.4
8,672,595 B2 * 3/2014 Goettlich ..... F16B 13/063 411/57.1
2010/0114181 A1 * 5/2010 Lob ..... A61B 17/68 606/326
2010/0122448 A1 * 5/2010 Slepecki ..... E04H 13/003 29/700
2011/0038686 A1 * 2/2011 Glogger ..... F16B 13/141 411/511

FOREIGN PATENT DOCUMENTS

JP H01114728 U 5/1989
JP S60203762 A 12/1994
JP 2005188177 A 7/2005
JP 2008126544 A 6/2008

* cited by examiner

ANCHOR FOR REINFORCING BAR MADE OF FIBER-REINFORCED PLASTIC AND MANUFACTURING METHOD THEREFOR

CROSS-REFERENCE TO RELATED APPLICATION

The present application claims priority to Japanese patent application No. 2022-035763 filed on Mar. 9, 2022, the contents of which are hereby fully incorporated herein by reference.

BACKGROUND OF THE INVENTION

Technical Field

The present invention generally relates to an anchor for use in tensioning a reinforcing bar made of fiber-reinforced plastic (polymer) to be used in prestressed concrete (PC) and to a method of manufacturing the same.

Related Art

In the prestressed concrete (PC) field, it is known to place tensioned PC steel bars within the concrete prior to curing (hardening) the concrete, in order to impart a compressive force to the cured (hardened) concrete owing to restoring force of the PC steel bars that results when the tension on the steel bars is released, thereby increasing the strength of the prestressed concrete (PC). One way to tension the PC steel bars is to attach anchors to respective ends of the steel bar and then affix one of the ends to a jack or other tensioning device via the anchor, in order to thereby stretch (tension) the steel bar. Such a conventional anchor typically includes either a wedge positioned in a sleeve as disclosed in Japanese Patent Laid-Open Publication No. 2008-126544 or a screw structure as disclosed in Japanese Patent Laid-Open Publication No. 2005-188177.

In recent years, attempts have been made to use reinforcing bars made of fiber-reinforced plastic (FRP) instead of PC steel bars. However, a conventional anchor that includes a conventional wedge is likely to damage the surface of a reinforcing bar made of FRP because a corner of the wedge digs (bites) into the reinforcing bar. In addition, a sleeve and wedge of a conventional anchor have a complicated structure, which necessitates a longer manufacturing time. In the alternative, it is also difficult to utilize a conventional screw structure with a reinforcing bar made of FRP.

SUMMARY OF THE INVENTION

It is one non-limiting object of the present teachings to disclose techniques for improving an anchor for use in tensioning a reinforcing bar made of FRP and for improving a method of manufacturing the same. Such techniques make possible an anchor for use in tensioning a reinforcing bar made of FRP that is simple in structure and does not damage a surface of the reinforcing bar made of FRP during the tensioning operation. Furthermore, anchors disclosed herein can reliably affix a reinforcing bar made of FRP to a jack or other tensioning device.

In a first aspect of the present teachings, an anchor for use in tensioning a reinforcing bar made of FRP in a prestressed concrete application may include: a pair of anchor pieces (1A, 1B) made of elongated metal plates (11), the two anchor pieces (1A, 1B) being in contact with each other in a detachable manner. A plurality of elongated holes (12) extends (in parallel) in a width direction of each of the anchor pieces (1A, 1B), the elongated holes (12) being formed (defined) at regular (e.g., equal) interval(s) in a longitudinal direction of each of the anchor pieces (1A, 1B). At least one locking half portion (13) can be formed in each of the anchor pieces (1A, 1B) by deforming an area (Y) of the elongated metal plates between adjacent elongated holes (12) to become convex (protruding) in a semicircular shape (e.g., a substantially quarter sphere shape) in a direction opposite to a direction of the contact of the two anchor pieces. At least one annular locking portion (14) is formed (defined) by opposing locking (engaging) half portions (13) in a state in which the two anchor pieces (1A and 1B) are in contact with each other. The annular locking (engaging) portion (14) defines (bounds, delimits) a circular inner space (in transverse cross-section) having a diameter that is smaller than the diameter of the reinforcing bar (Rb) made of FRP, which will be tensioned to prestress concrete.

In the above-described first aspect, an opening edge of each locking portion is designed to be in pressure contact with the outer circumference of the reinforcing bar when the anchor pieces are mounted on (affixed to) the reinforcing bar. The force of the pressure contact is generated, in part, by the elasticity of the elongated metal plates, and can be prevented from being (becoming) excessively large by appropriately setting (selecting) the thickness of the metal plates prior to making the anchor pieces. Therefore, it is possible to design the anchor pieces such that the force of the pressure contact will not damage the outer (circumferential) surface of the reinforcing bar made of FRP during usage of the anchor to tension the reinforcing bar. Such a locking structure has a simpler structure than conventional anchors used in the prestressed concrete field.

In a second aspect of the present teachings, the anchor may be configured such that the at least one annular locking portion (14) includes an annular portion having an identical inward inclination in a longitudinal cross-sectional view.

In the above-described second aspect, when the tensioning force is applied to the reinforcing bar, the tensioning force acts on the anchor in a direction that would (otherwise) pull the reinforcing bar out of the anchor. However, the tensioning force causes the smaller-diameter opening edges of the locking portion(s) to deform owing to the pressure contact with the outer circumference of the reinforcing bar so as to further reduce the size of the opening diameter. This feature of the present teachings reliably prevents the reinforcing bar Rb from coming out of the anchor during a tensioning operation.

In a third aspect of the present teachings, a method of manufacturing an anchor for use in tensioning a reinforcing bar made of FRP may include: providing an elongated metal plate (11) with (having) a plurality of elongated holes (12) that each extend in a width direction of the elongated metal plate (11), the elongated holes (12) being provided (defined) at regular (e.g., equal) intervals in a longitudinal direction of the elongated metal plate (11); forming an anchor piece (1, 1A, 1B) that includes at least one locking half portion (13), which has a convex (protruding) semicircular shape (e.g., a substantially quarter sphere shape) by respectively pressing (stamping) areas or portions (Y) of the metal plate surface between adjacent ones of the elongated holes (12) from one side toward the other side; and bringing contacting surfaces of two anchor pieces (1A, 1B), which were formed according to the preceding steps, into contact with each other in a detachable manner, and then causing (positioning) the opposing locking half portions (13) to form at least one annular locking portion (14) that encloses a circular interior space (in transverse cross-section) and has a diameter smaller than the diameter of the reinforcing bar made of FRP (Rb) that will be placed between the two anchor pieces (1A, 1B) during a tensioning operation. Herein, the contacting surfaces of the anchor pieces that are brought into contact are on a side opposite to the side on which the convex portion(s) of the locking half portion(s) (13) protrude(s).

According to the above-described method of manufacturing, the anchor pieces of the first aspect can be easily manufactured by using a machine press (stamping press).

In a fourth aspect of the present teachings, the second step of the above-described manufacturing method includes forming at least one of the anchor pieces (1, 1A, or 1B), which includes at least one locking half portion (13) at an area(s) or portion(s) (Y) of the plate surface area (Y) between two adjacent elongated holes (12), by unevenly pressing the area or portion (Y) from one side so as to be convex (protruding) on the other side in a semicircular shape (or substantially quarter sphere shape). As a result, the locking half portion (13) will become more convex (will bulge more) in the longitudinal direction of the locking half portion (13) from one side edge to the other side edge in the longitudinal direction.

According to the above-described fourth aspect, the anchor of the second aspect can be easily manufactured by using a machine press (stamping press).

The above numerals in parentheses indicate, for reference and explanatory purposes only, representative, non-limiting correspondence relationships with specific structures described in the below-described embodiment of the present teachings. Such reference numbers are not intended to restrict or limit the scope of the present teachings in any manner.

As described above, the present teachings enable an anchor to be formed in a simple manner and with a design that does not damage the surface of the reinforcing bar made of FRP during a tensioning operation. Therefore, a reinforcing bar made of FRP can be reliably affixed to a jack or other tensioning device, in order to be tensioned.

DETAILED DESCRIPTION OF THE PREFERRED EMBODIMENTS

It is noted that the representative exemplary embodiments described below are merely examples of the present teachings, and various design improvements, which may be made by one of ordinary skill in the art without departing from the spirit of the present invention, are also encompassed within the scope of the present invention.

Figure 1:
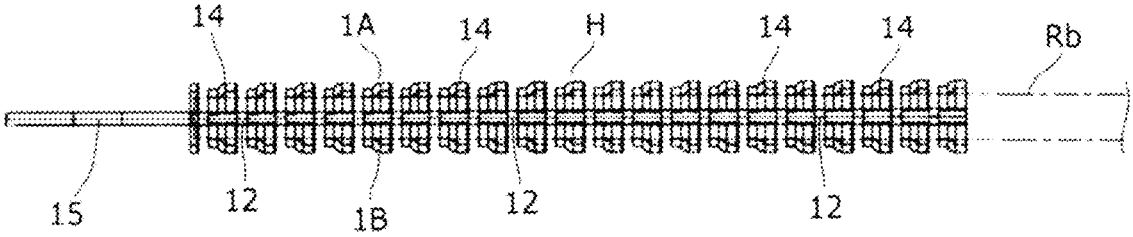
FIG. 1 is an overall side view of one representative, non-limiting anchor according to the present teachings.
Figure 2:
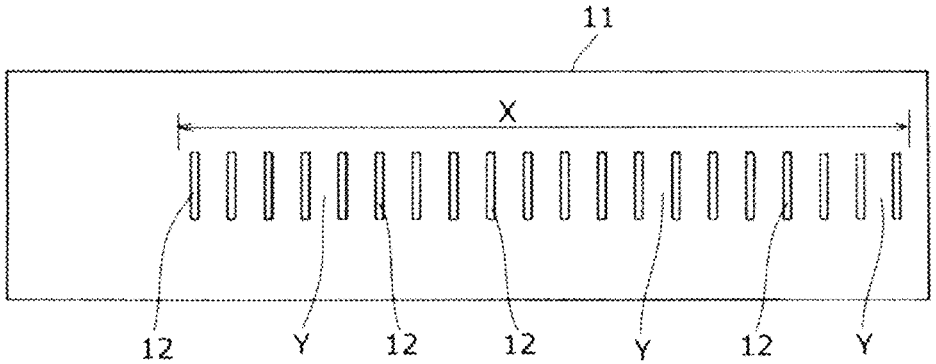
FIG. 2 is an overall plan view of a metal plate of the anchor shown in FIG. 1.

FIG. 1 shows a side view of an anchor H of one representative non-limiting embodiment of the present teachings in the state of being attached to an end portion of a reinforcing bar Rb made of fiber-reinforced plastic "FRP" (hereinafter simply referred to as reinforcing bar Rb). The anchor H is composed of a pair of (i.e. upper and lower) anchor pieces 1A and 1B that have symmetrically identical shapes and are in contact with each other. The anchor pieces 1 (1A, 1B) can be manufactured, e.g., by press forming (e.g., stamping). For example, as shown in FIG. 2, an elongated metal plate (blank) 11 having a length equal to the length of the anchor piece 1 (1A, 1B) may first be prepared or provided, and then the required number of rectangular elongated holes (slots) 12 extending in the width direction may be punched out (pierced) at equal intervals along the longitudinal direction of the plate surface, except for at one end portion of the anchor pieces 1, 1A, 1B (e.g., the left end portion of the anchor pieces in FIG. 2 does not have any holes 12, so that a connection hole 15 (described below) can be formed therein). In the elongated metal plate (blank) 11 shown in FIG. 2, twenty elongated holes 12 have been formed. The elongated holes 12 are aligned in the longitudinal direction, i.e. the holes 12 extend in parallel to each other. Subsequently, areas or portions Y of the metal plate 11 surface between adjacent ones of the elongated holes 12 are respectively pressed (stamped, bent, deformed) using upper and lower dies 2, 3 having a length substantially equal to the length of the area X in which the elongated holes 12 are formed in the metal plate 11.

Figure 3:
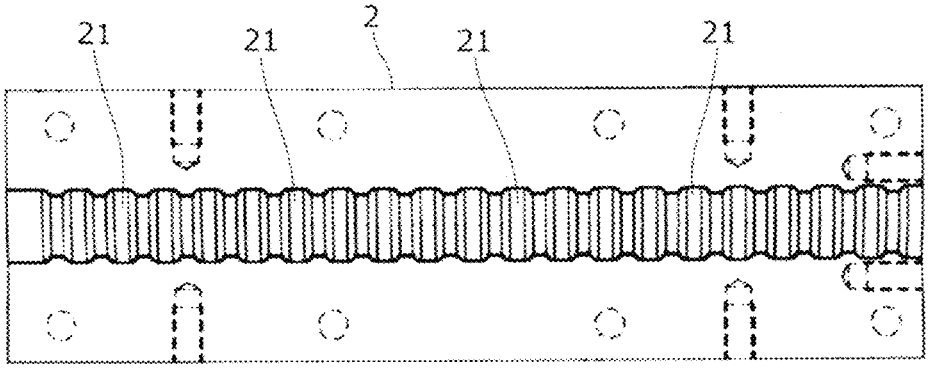
FIG. 3 is an overall plan view showing a die surface of a lower die for forming the anchor shown in FIG. 1.
Figure 4:
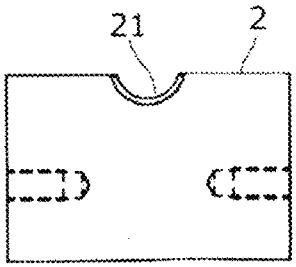
FIG. 4 is a longitudinal end view of the lower die.
Figure 5:
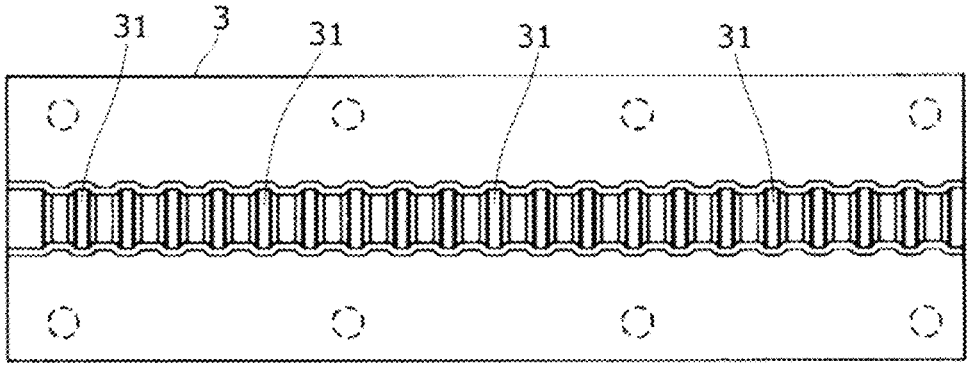
FIG. 5 is an overall plan view showing a die surface of an upper die for forming the anchor shown in FIG. 1.
Figure 6:
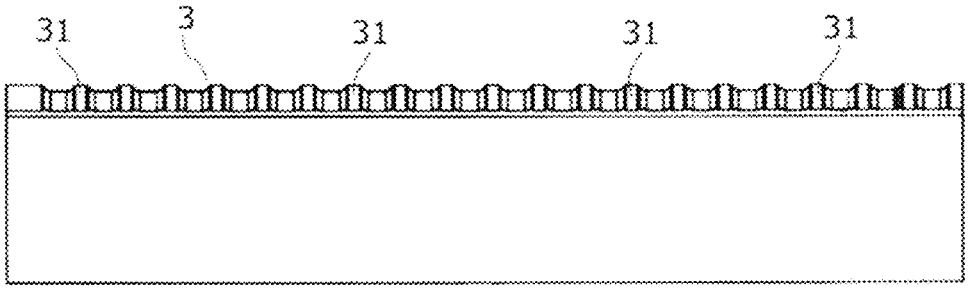
FIG. 6 is an overall side view of the upper die.
Figure 7:
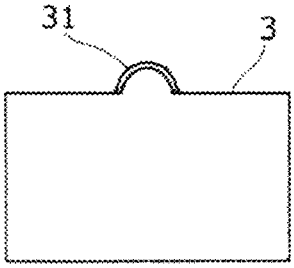
FIG. 7 is a longitudinal end view of the upper die.

More specifically, FIG. 3 shows a plan view of the lower die 2, and FIG. 4 shows a longitudinal end view thereof. A portion of the surface of the lower die 2 has a plurality of semicircular (quarter spherical) concave portions (recesses) 21 formed in the center thereof in the width direction (FIG. 4). The concave portions (recesses) 21 are recessed from a reference (base) surface of the lower die 2 in a shell or arc shape that enlarges (bulges) downwardly in a first longitudinal direction or tapers towards the reference surface in a second longitudinal direction that is colinear with, but opposite of the first longitudinal direction. In the present embodiment, nineteen concave portions 21 are formed at equal intervals (spacings) in the longitudinal direction so as to correspond to the nineteen areas Y in the metal plate 11. On the other hand, FIG. 5 shows a plan view of the upper die 3, FIG. 6 shows a side view thereof, and FIG. 7 shows a longitudinal end view thereof. FIGS. 6 and 7 are upside down in the state in which the upper die 3 is being used with the lower die 2 to press (stamp, deform) elongated metal plates (blanks) 11. A portion of the surface of the upper die 3 has a plurality of semicircular convex portions 31 formed in the center thereof in the width direction (FIG. 7). Similar to the concave portions (recesses) 21, the convex portions 31 are also formed at equal intervals (spacings) in the longitudinal direction so as to correspond to the concave portions 21 of the lower die 2. The convex portions (protrusions) 31 protrude or project from a reference (base) surface of the upper die 3 in a shell or arc shape that enlarges (bulges) downwardly in a first longitudinal direction or tapers towards the reference surface in a second longitudinal direction that is colinear with, but opposite of the first longitudinal direction. In the present embodiment, nineteen of the convex portions 31 are also formed. In an anchor piece manufacturing process, the upper and lower dies 2, 3 are mounted on a machine press or stamping press such that the convex portions 31 of the upper die 3 are slightly shifted (displaced) in the longitudinal direction from positions that would exactly face (match) the respective (corresponding) concave portions 21 of the lower die 2. It is noted that the concave portions (recesses) 21 and the convex portions (protrusions) 31 may also be referred to as semi hemispherical shaped (or substantially semi hemispherical (shell) shaped) or quadrant shaped (or substantially quadrant (shell) shaped), in addition to the above-mentioned semicircular shape or quarter sphere shape. The resulting locking half portions 13 defined on the anchor pieces 1A, 1B also may be referred to by the same geometrical designations, or the alternate geometrical designations described herein.

Figure 8:
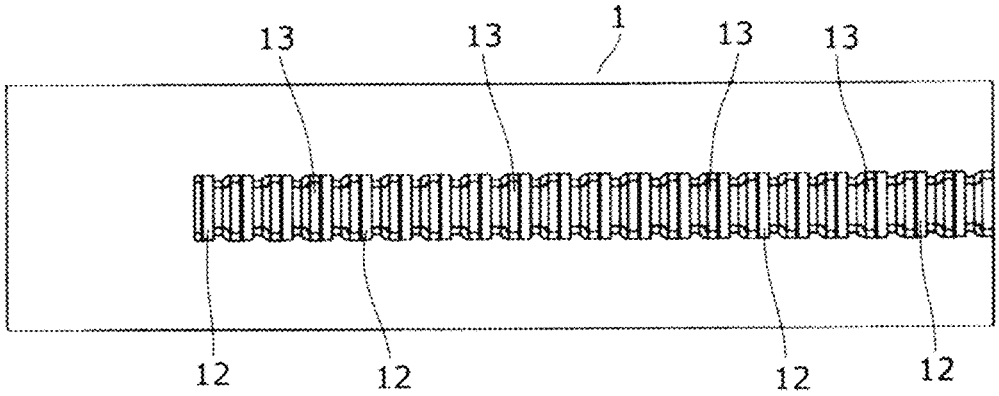
FIG. 8 is an overall plan view of an anchor piece.
Figure 9:
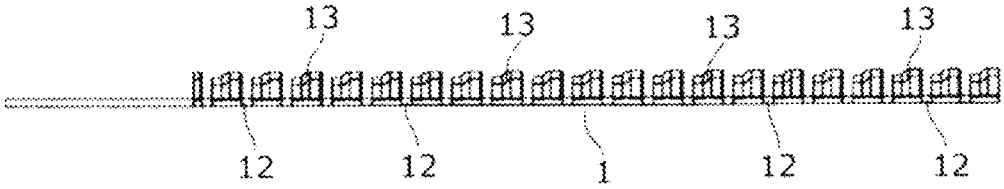
FIG. 9 is an overall side view of the anchor piece.
Figure 10:
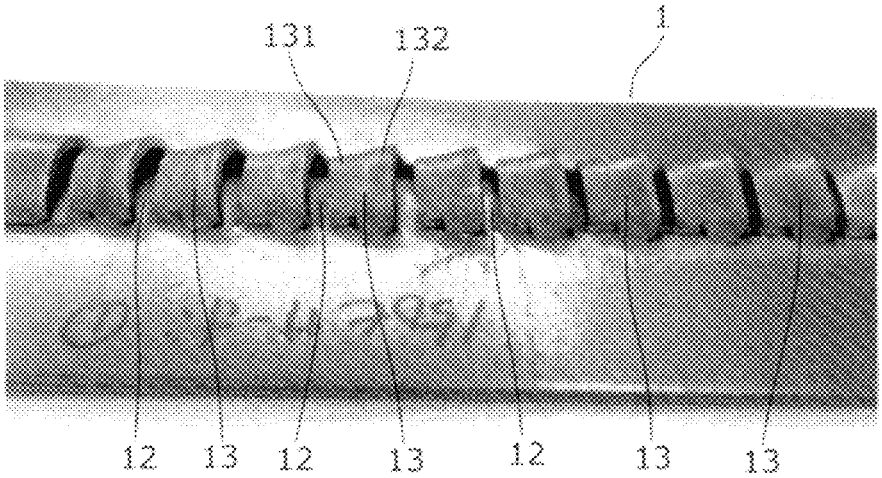
FIG. 10 is a partially enlarged perspective view of the anchor piece.
Figure 11:
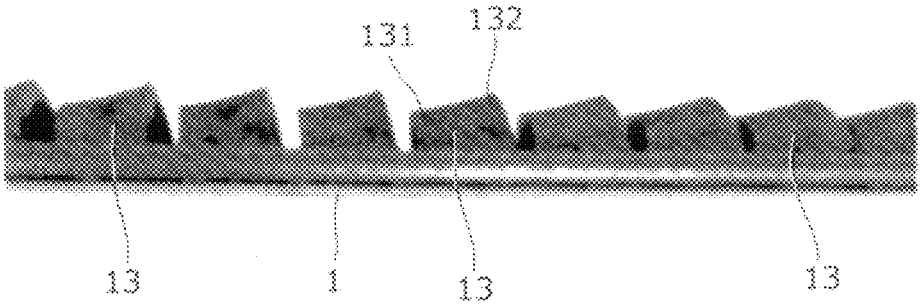
FIG. 11 is a partially enlarged side view of the anchor piece.

As was noted above, to form (shape) anchor pieces 1A, 1B, the lower die 2 and the upper die 3 are mounted in a machine press (stamping press). Then, an elongated metal plate (blank) 11 is disposed at a predetermined location between the lower die 2 and the upper die 3. Then, the upper die 3 is moved towards the lower die 2 (or vice versa) so that the convex portions 31 of the upper die 3 are caused to enter the respective (corresponding) concave portions 21 of the lower die 2 with the areas Y of the metal plate (blank) 11 respectively disposed therebetween and thus deformed thereby. As a result, the nineteen areas Y of the metal plate 11 are pressed (stamped, curvedly bent) downward to form one anchor piece 1 (1A, 1B) having convex locking half portions 13 (FIGS. 8 and 9). It is noted that the left-right direction in FIGS. 3 and 5 is opposite to each other when the dies 2, 3 are mounted on the machine press (stamping press). An enlarged perspective view of such an anchor piece 1 is shown in FIG. 10, and an enlarged side view thereof is shown in FIG. 11. As is clear from FIGS. 10 and 11, each locking half portion 13 of the anchor piece 1 (1A, 1B) is formed so as to increase in size (become more convex or protruding (bulging)) in the (first) longitudinal direction that proceeds from one side edge 131 to the other side edge 132. As a result, the semicircular (e.g., substantially quarter sphere) portion is inclined downwardly toward the one side edge 131. FIGS. 9 to 11 are upside down during an actual anchor piece manufacturing (forming, stamping) process.

After a pair of anchor pieces 1 (1A, 1B) has been formed in the above-described manner, the two anchor pieces 1A and 1B are placed into contact with each other symmetrically along the respective flat (contacting) surfaces, i.e. on the side opposite to the side from which the convex locking half portions 13 protrude from the reference (base) surface, as shown in FIG. 1. As a result, the opposing locking half portions 13 constitute the anchorage portion of the anchor H, which includes locking portions 14 having round (e.g., truncated cone-shaped) interior (hollow) spaces that are formed (defined) at equal intervals (distances) in the longitudinal direction. Each of the locking portions 14 includes an annular portion and all of the annular portions of the locking portions 14 have an identical inward (downward) inclination in a longitudinal cross-sectional view. Furthermore, the anchor pieces 1A, 1B each have mounting holes (not shown) defined at required locations, and are detachably joined together by inserting bolts into the respective mounting holes while the anchor pieces 1A, 1B are in contact with each other and then tightening nuts thereon. The anchor pieces 1A, 1B each have a connection hole 15 (FIG. 1), which are for connection to a jack or other tensioning device, in the end (end portion) of the metal plate 11 that does not have the locking half portions 13.

To use the anchor H to prestress concrete, two of the anchor pieces 1A, 1B are joined together as follows. In the state in which the anchor pieces 1A, 1B are separated, an end portion of the reinforcing bar Rb is inserted between the anchor pieces 1A, 1B such that the reinforcing bar Rb is positioned between the anchor pieces 1A and 1B as shown in FIG. 1, i.e. an end portion of the reinforcing bar Rb is disposed inside (between) the anchor pieces 1A, 1B adjacent (next to) the portion of the anchor pieces 1A, 1B that does not have locking half portions 13 such that the distal end of the reinforcing part Rb emerges (projects) from the opposite end of the anchor pieces 1A, 1B having the locking half portions 13. Then, the anchor pieces 1A, 1B are pressed together until the smallest (innermost) opening edge of each locking portion 14, which has a diameter smaller than the diameter of the reinforcing bar Rb, is in pressure contact with the outer circumference (surface) of the reinforcing bar Rb. Because the pressing force is influenced by the elasticity of the metal plates 11, the pressing force can be prevented from being (becoming) excessively large by appropriately setting (selecting) the thickness of the metal plates 11 prior to manufacturing the anchor pieces 1A, 1B, thereby preventing damage to the reinforcing bar Rb made of fiber-reinforced plastic (polymer), which is softer than metal and thus more easily damaged than metal.

As can be understood from viewing FIGS. 1, 2 and 9-11 together, each of the anchor pieces 1A, 1B has a flat plate shape overall with bulges defining the convex locking half portions 13 that extend along the longitudinal direction of the anchor pieces 1A, 1B. That is, on each side of the convex locking half portions 13 in the width direction, which is perpendicular to the longitudinal direction, a flat flange portion is provided. The locking half portions 13 are rigidly connected to the flat flange portions.

As was noted above, the mounting holes (not shown) may be provided in each of these flat flange portions. In addition, as can be seen in FIGS. 1, 2 and 9, an additional flat flange portion is provided at one longitudinal end (the left side in FIGS. 1, 2 and 9) of each of the anchor pieces 1A, 1B and has a width greater than the width of the elongated holes 12 and locking half portions 13 in the width direction. The connection hole 15 extends through each of these additional flat flange portions in a direction that is perpendicular to the longitudinal direction.

In this anchor-assembled state, when a jack or tensioning device is attached to the anchor pieces 1A, 1B via the connection holes 15 and then applies a large tensile force, via the anchor pieces 1A, 1B, to the reinforcing bar Rb to tension the reinforcing bar Rb, a force acts on the reinforcing bar Rb in the longitudinal direction thereof (i.e. in the direction that would pull the anchor H off of the reinforcing bar Rb). However, because the smallest-diameter (innermost) opening edges of the locking portions 14 are in pressure contact with the outer circumference of the reinforcing bar Rb, the smallest-diameter opening edges of the locking portions 14 will be deformed when the tension is applied to the anchor H, which will further reduce the opening diameter of the locking portions 14, thereby reliably preventing the anchor H from coming off of (separating) from the reinforcing bar Rb during a tensioning operation.

As described above, the anchor H of this embodiment can be easily manufactured by press forming two of the metal plates 11 and has a simple structure. Furthermore, the pressure contact of the locking portion(s) 14 against the outer circumference of the reinforcing bar Rb can be appropriately adjusted by changing the elasticity of the metal plates 11 (e.g., by changing the thickness of the metal plates 11). Moreover, the deformation of the locking portion(s) 14 that prevents the anchor H from coming off of the reinforcing bar Rb enables the reinforcing bar Rb to be reliably held in the anchor H, so that the tensile force applied by the jack or the like to the anchor H can be reliably transmitted to the reinforcing bar Rb.

It is noted that, in the above embodiment, the number of locking portions 14 formed on the anchor H can be appropriately increased or decreased depending on the tensile force required to tension the reinforcing bar Rb.

Furthermore, in another possible modification of the above embodiment, if it is possible to sufficiently prevent the tensioned reinforcing bar Rb from separating (coming off) from the anchor H merely by the fact that the opening edges of the locking portions 14, which each have a diameter smaller than the outer diameter of the reinforcing bar Rb, are in pressure contact with (are pressed against and are deformed by the tension applied to the anchor H, thereby biting into the reinforcing bar Rb) the outer circumference of the reinforcing bar Rb, then the annular portions of the locking portions 14 may be modified to be parallel circular rings instead of being tilted inward or outward (e.g., in the substantially semicircular or quarter sphere shape shown in FIG. 1).

Representative, non-limiting examples of the present invention were described above in detail with reference to the attached drawings. This detailed description is merely intended to teach a person of skill in the art further details for practicing preferred aspects of the present teachings and is not intended to limit the scope of the invention. Furthermore, each of the additional features and teachings disclosed above may be utilized separately or in conjunction with other features and teachings to provide improved anchors for reinforcing bars made of fiber-reinforced plastic and methods of manufacturing the same.

Moreover, combinations of features and steps disclosed in the above detailed description may not be necessary to practice the invention in the broadest sense, and are instead taught merely to particularly describe representative examples of the invention. Furthermore, various features of the above-described representative examples, as well as the various independent and dependent claims below, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

REFERENCE SYMBOL LIST

1, 1A, 1B . . . anchor piece
11 . . . metal plate
12 . . . elongated hole
13 . . . locking half portion
14 . . . locking portion
Y . . . area of metal plate

What is claimed is:

1. An anchor for a reinforcing bar made of fiber-reinforced plastic, comprising:

first and second anchor pieces each made of an elongated metal plate, the first and second anchor pieces being in contact with each other in a detachable manner;

wherein:

a plurality of elongated holes is defined in each of the first and second anchor pieces such that the elongated holes each extend in a width direction of each of the first and second anchor pieces, and the elongated holes are defined at regular intervals in a longitudinal direction of each of the first and second anchor pieces;

at least one locking half portion is defined on each of the first and second anchor pieces between adjacent ones of the elongated holes and has a convex semicircular shape that protrudes in a direction away from contacting surfaces of the first and second anchor pieces; and at least one annular locking portion is defined by cooperation of the at least one locking half portion of the first anchor piece and the at least one locking half portion of the second anchor piece, the annular locking portion defining an interior space that is circular in transverse cross-section and has a diameter smaller than the diameter of the reinforcing bar made of fiber-reinforced plastic.

2. The anchor according to claim 1, wherein the at least one annular locking portion includes an annular portion having an identical inward inclination in a longitudinal cross-sectional view.

3. The anchor according to claim 1, wherein the elongated holes are through holes that pass through the elongated metal plate.

4. The anchor according to claim 3, wherein:

each of the anchor pieces has a flat flange portion at one end in the longitudinal direction; and each of the flat flange portions has a width in the width direction that is greater than the width of the locking half portions in the width direction.

5. The anchor according to claim 4, wherein a connection hole passes through both of the flat flange portions in a direction perpendicular to the longitudinal direction.

6. The anchor according to claim 5, wherein:

the at least one annular locking portion has an outer surface that is circular in a cross-section perpendicular to the longitudinal direction;

the at least one locking portion is tilted or tapered in the longitudinal direction toward the connection hole such that a narrowest portion of the at least one annular locking portion is closer to the connection hole than a widest portion of each of the locking portions; and the narrowest portion of the at least one annular locking portion is configured to bite into the reinforcing bar in a state in which the reinforcing bar is disposed within the interior space of the annular locking portion.

7. A method of manufacturing the anchor according to claim 1, the method comprising:

providing two elongated metal plates each having a plurality of elongated holes extending in a width direction of the first and second elongated metal plates, the elongated holes being provided at regular intervals in a longitudinal direction of the elongated metal plates;

forming first and second anchor pieces each having at least one locking half portion that has a convex semicircular shape by pressing an area between two adjacent ones of the elongated holes from one side toward the other side to form the at least one lock half portion; and bringing the first and second anchor pieces into contact with each other in a detachable manner such that the locking half portion of the first anchor piece opposes the locking half portion of the second anchor piece to form at least one annular locking portion having a circular interior space in transverse cross-section, the circular interior space having a diameter that is smaller than the diameter of the reinforcing bar made of fiber-reinforced plastic, and the at least one locking half portion of the first and second anchor pieces protrudes in a direction away from contacting surfaces of the first and second anchor pieces.

8. The method according to claim 7, wherein in the step of forming the first and second anchor pieces, the area is unevenly pressed from one longitudinal side so as to have the convex semicircular shape with respect to an opposite longitudinal side, such that the convexity of each of the at least one locking half portions increases as the at least one locking half portion proceeds from one longitudinal side edge to an opposite longitudinal side edge in the longitudinal direction.

9. A method of tensioning a reinforcing bar using the anchor according to claim 1, comprising:

sandwiching the reinforcing bar between the first and second anchor pieces, and applying a tension force to a first end of the anchor opposite of a second end of the anchor from which the reinforcing bar emerges from the anchor, thereby causing opening ends of the locking portions to deform and bite into an outer circumference of the reinforcing bar.

10. An anchor for a reinforcing bar made of fiber-reinforced plastic, comprising:

a first anchor piece made of a first elongated metal plate and having a first contacting surface; and a second anchor piece made of a second elongated metal plate and having a second contacting surface that detachably contacts the first contacting surface of the first anchor piece;

wherein:

a plurality of elongated holes is defined in each of the first and second anchor pieces such that the elongated holes each extend in parallel in a width direction of each of the first and second anchor pieces;

the elongated holes are defined at equispaced intervals in a longitudinal direction of each of the first and second anchor pieces, the longitudinal direction being perpendicular to the width direction;

at least one locking half portion is defined on each of the first and second anchor pieces between adjacent ones of the elongated holes and has a convex semicircular shape that protrudes in a direction away from first and second contacting surfaces of the first and second anchor pieces;

the at least one locking half portion of the first anchor piece and the at least one locking half portion of the second anchor piece together form an annular locking portion defining an interior space that is circular in transverse cross-section; and at least a portion of the interior space has a diameter in the transverse cross-section that is smaller than the diameter of the reinforcing bar made of fiber-reinforced plastic such that the at least one locking half portion of the first anchor piece and the at least one locking half portion of the second anchor piece will bite into and engage the reinforcing bar in the state in which a reinforcing bar is disposed in the interior space, the first and second anchor pieces are affixed to each other and a force that tensions the reinforcing bar is applied to the anchor.

11. The anchor according to claim 10, further comprising a connection hole for connecting to a jack or other tensioning device passing through an overlapping portion of the first and second anchor pieces in a direction perpendicular to the longitudinal direction, the connection hole being formed in a flat end portion of each of the first and second anchor pieces that does not have any of the elongated holes.

12. The anchor according to claim 11, wherein:

the anchor has a plurality of the annular locking portions respectively provided between adjacent ones of the elongated holes; and each of the annular locking portions has an identical shape.

13. The anchor according to claim 12, wherein each of the locking portions is fixed relative to the elongated metal plate and is tilted or tapered in the longitudinal direction toward the connection hole such that a narrowest internal portion of each of the locking portions is closer to the connection hole than a widest internal portion of each of the locking portions.

14. The anchor according to claim 13, wherein each of the annular locking portions has an at least substantially truncated cone shape.

15. The anchor according to claim 10, wherein the elongated holes are through holes that pass through the elongated metal plate and the annular locking portion is rigidly connected to flange portions of the elongated metal plate that are on opposite sides of the annular locking portion in the width direction.

16. A method of tensioning a reinforcing bar using the anchor according to claim 11, comprising:

sandwiching the reinforcing bar between the first and second anchor pieces, and applying a tension force to a first end of the anchor opposite of a second end of the anchor from which the reinforcing bar emerges from the anchor, thereby causing opening ends of the annular locking portions to deform and bite into an outer circumference of the reinforcing bar.

17. The method according to claim 16, further comprising, after sandwiching the reinforcing bar between the first and second anchor pieces, attaching a jack or other tensioning device to the connection hole and then actuating the jack or other tensioning device to tension the reinforcing bar.

18. The method according to claim 17, wherein:

the anchor has a plurality of the annular locking portions respectively provided between adjacent ones of the elongated holes; and each of the annular locking portions has an identical shape.

19. The method according to claim 18, wherein each of the locking portions is tilted or tapered in the longitudinal direction toward the connection hole.

20. The method according to claim 19, wherein each of the annular locking portions has an at least substantially truncated cone shape.

* * * * *